US006152780A

United States Patent [19]

Burke

[11] Patent Number: 6,152,780

[45] Date of Patent: Nov. 28, 2000

[54] ELECTRICAL CONNECTOR WITH ELECTRICALLY CONDUCTIVE PLATES

[75] Inventor: Kevin Burke, Middleton, Wis.

[73] Assignee: JME Inc., Englewood, N.J.

[21] Appl. No.: 09/225,107

[22] Filed: Jan. 4, 1999

[51] Int. Cl.[7] ..... H61R 13/10

[52] U.S. Cl. ..... 439/682; 439/108

[58] Field of Search ..... 439/682, 108, 439/101, 721, 76.2, 683, 684, 685, 686, 687, 688, 689, 690, 691, 692, 620

[56] References Cited

U.S. PATENT DOCUMENTS

| | | | |
|---|---|---|---|
| 4,020,430 | 4/1977 | Vander Heyden | 439/620 |
| 4,029,386 | 6/1977 | Krantz, Jr. et al. | 439/608 |
| 4,440,463 | 4/1984 | Gliha, Jr. et al. | 439/92 |
| 4,979,904 | 12/1990 | Francis | 439/108 |
| 5,586,912 | 12/1996 | Eslampour et al. | 439/620 |
| 5,603,640 | 2/1997 | Mouissie | 439/620 |

*Primary Examiner*—Paula Bradley
*Assistant Examiner*—Ross Gushi
*Attorney, Agent, or Firm*—Jones, Day, Reavis & Pogue

[57] ABSTRACT

An electrical connector having a plurality of contacts divided into three groups based on height and location where the first group is tall in a peripheral array, the second group is short in the peripheral array and the third group is short in a smaller inner array. A first electrically conductive plate is mounted to the first group of contacts and fastened by screws which are received in central longitudinal threaded holes in the first group of contacts. In a like manner, a second electrically conductive plate is connected to the third group of contacts using screws which are received in central longitudinal holes of the short contacts. Each of the plates has a central opening which is fitted with a screw which allows electrical connections to be made with other circuitry or components.

17 Claims, 2 Drawing Sheets

ELECTRICAL CONNECTOR WITH ELECTRICALLY CONDUCTIVE PLATES

BACKGROUND OF THE INVENTION

1. Field of the Invention

The present invention relates to an electrical connector having electrically conductive plates and more particularly to an electrical connector having two circular arrays of electrically conductive contacts of different heights and including two electrically conductive plates, one ground and one neutral, connecting selective groups of the contacts.

2. Description of the Related Art

Electrical connectors having a generally cylindrical housing and multiple electrically conductive contacts are well known devices. The devices provide separable connections for a plurality of electrical circuits to carry power or signals between different locations. In certain situations, it has been found desirable to create an electrical connection between a number of selected contacts. This was typically accomplished by using wires which were mechanically attached to each of the contacts to be connected. Using individual wires are, of course, labor intensive and not entirely reliable.

More recently, as shown, for example, in U.S. Pat. No. 4,979,904, an electrically conductive disk having an array of openings to correspond to selected contacts is disclosed to be used for grounding these contacts. As set forth in that patent, the holes in the disks are made slightly smaller than the dimensions of the contacts and the disk is engaged with the contacts by a pressed fitting operation. Such a method of connection is more efficient than individual wires being connected to and between contacts, but under vibratory conditions or if the disk is removed and reinstalled, the disk may become loose and disengage from one or more of the contacts.

BRIEF DESCRIPTION OF THE INVENTION

The difficulties encountered by the previous systems have been overcome by the present invention. What is described here is an electrical connector comprising a housing, a plurality of electrically conductive contacts mounted to the housing, the contacts being divided into at least three groups, a first electrically conductive plate having a plurality of openings to be used to connect to a first group of the three groups of contacts, a second electrically conductive plate having a plurality of openings to be used to connect to a third group of the three groups of contacts, and wherein a second group of the three groups of contacts does not make electrical contact with either the first or the second electrically conductive plates.

It is an object of the present invention to provide an electrically conductive connector having multiple contacts with electrically conductive plates that connect selected groups of the contacts in a simple, inexpensive and reliable manner.

Another aspect of the present inventions is to provide an electrically conductive connector having multiple contacts with electrically conductive plates that are engaged to the contacts in a secure fashion. A further advantage of the present invention is to provide a multi-contact electrically conductive connector with electrically conductive plates connecting selected groups of contacts which allows for simple and reliable electrical connections to other electrical components or circuitry.

A more complete understanding of the present invention and other objects, aspects, aims and advantages thereof will be gained from a consideration of the following description of the preferred embodiment read in conjunction with the accompanying drawings provided herein.

DESCRIPTION OF THE PREFERRED EMBODIMENTS

Figure 1:
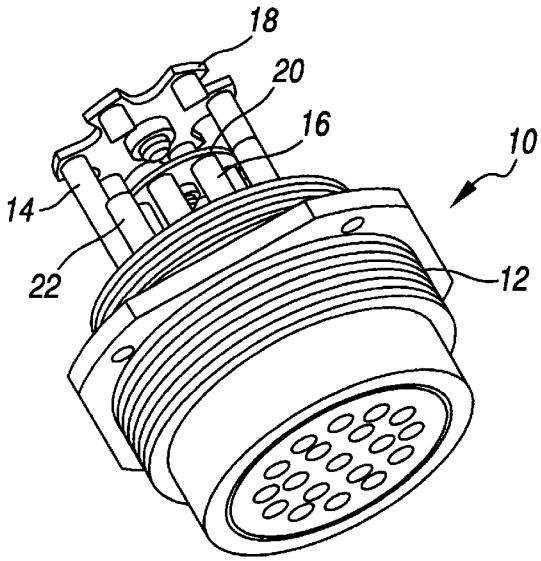
FIG. 1 is a perspective, partially broken away view of an electrical connector having multiple contacts and having two electrically conductive plates, each connected to a selected group of these contacts.

While the present invention is open to various modifications and alternative constructions, the preferred embodiments shown in the drawings will be described herein in detail. It is understood, however, that there is no intention to limit the invention to the particular forms disclosed. On the contrary, the intention is to cover all modifications, equivalent structures and methods, and alternative constructions falling within the spirit and scope of the invention as expressed in the appended claims.

Referring now to FIG. 1, there is shown an electrical connector 10 having a generally cylindrical housing 12 and a plurality of electrically conductive contacts such as a group of tall contacts exemplified by the tall contact 14 and a group of short contacts exemplified by the short contact 16. Connected to a predetermined group of tall contacts is a first electrically conductive plate 18 which may be referred to as a neutral common plate. Connected to the group of short contacts is a second electrically conductive plate 20 which may be referred to as a ground common plate.

Typically the housing 12 is made of electrically insulative material well known in the art while the contacts such as the contacts 14 and 16 are made of electrically conductive material.

Figure 2:
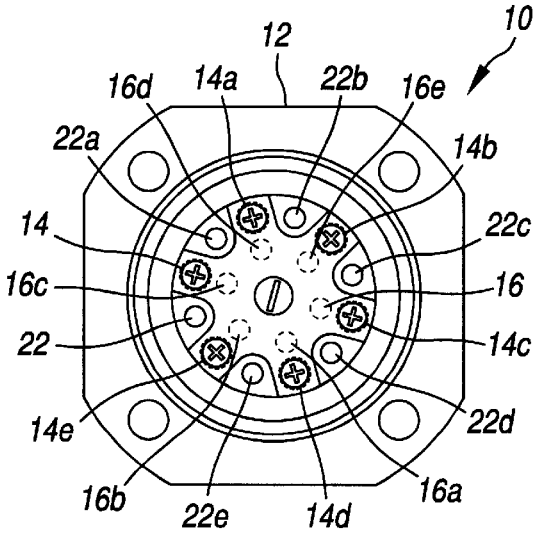
FIG. 2 is a top plan view of the electrical connector shown in FIG. 1.
Figure 3:
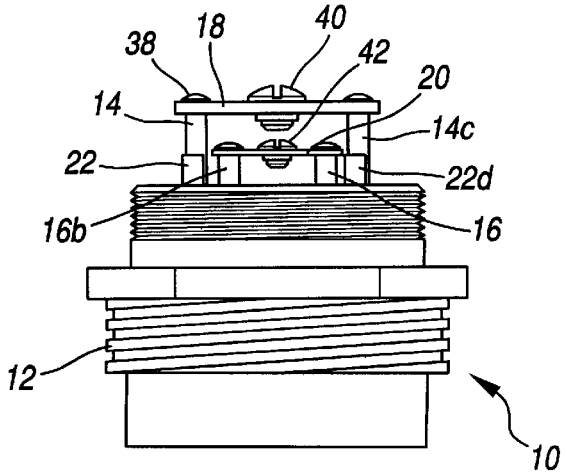
FIG. 3 is a front elevational view of the electrical connector shown in FIGS. 1 and 2.

Referring now to FIGS. 2 and 3, there is shown in more detail the structure of the connector 10. The contacts are divided into two lengths or heights. Using these height differences, the contacts may be divided into three groups, a first group consisting of the tall contacts (such as the contact 14), a second group consisting of some short contacts, such as the contact 22 and a third group consisting of other short contacts, such as the contact 16.

As can best be seen in FIG. 2, the three groups of contacts are arrayed in two circular configurations. The smaller or inner circular arrangement consisting of only the third group of short contacts 16, 16*a*, 16*b*, 16*c*, 16*d* and 16*e*. These may be labeled with identification markings thirteen-eighteen.

In a larger outer concentric configuration are the first and second groups comprising of tall and short contacts. These are located closer to the periphery of the connector and may bear the identification markings one-twelve. For ease of identification, the first group of tall contacts 14, 14*a*, 14*b*, 14*c*, 14*d* and 14*e* are labeled with even numbered markings two, four, six, eight, ten and twelve, while the short second group of contacts 22, 22*a*, 22*b*, 22*c*, 22*d* and 22*e* are labeled with odd numbers one, three, five, seven, nine and eleven.

Figure 4:
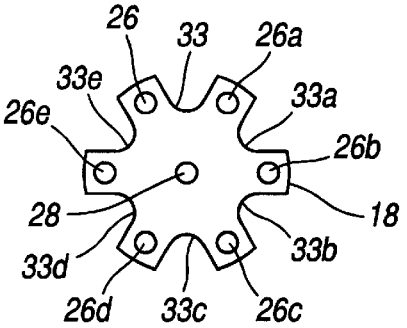
FIG. 4 is a top plan view of one embodiment of a neutral electrically conductive plate.
Figure 9:
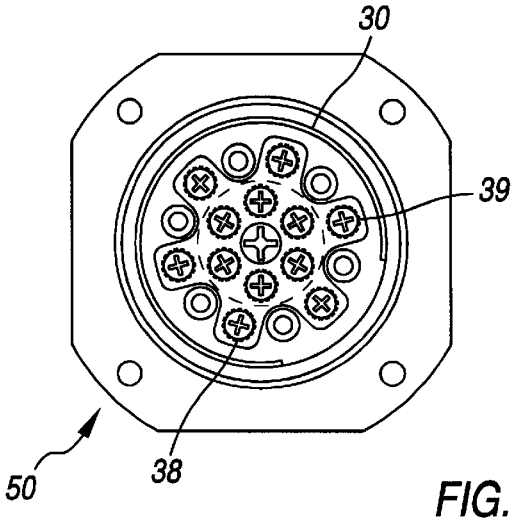
FIG. 9 is a top plan view of another embodiment of an electrical connector.
Figure 10:
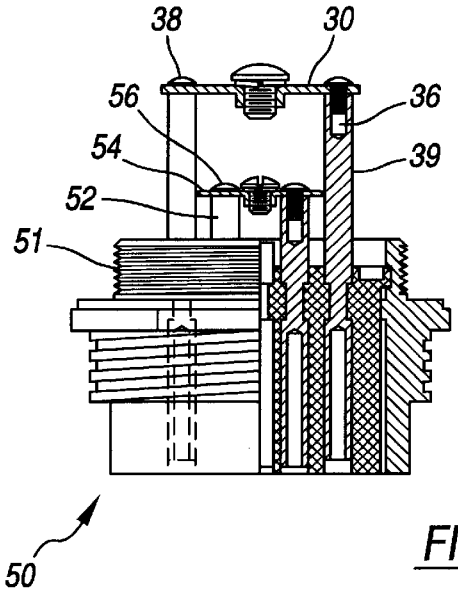
FIG. 10 is a front elevational view, partially in section, of the connector of FIG. 9.

As can be seen best from FIG. 4, the neutral common plate 18 includes a plurality of openings near its periphery, such as the holes 26, 26*a*, 26*b*, 26*c*, 26*d* and 26*e*. A central opening, such as a hole 28, is also provided. These peripheral holes are aligned with the first group of tall contacts, such as the contacts 14–14*e*, but are slightly smaller in diameter than the contacts. There is a second version of the neutral common plate shown in the drawings. The version illustrated in FIGS. 9 and 10 is a circular disk 30 with twelve peripheral openings or holes. In FIG. 4, the neutral common plate 18 has a generally circular configuration for the holes, but has only six peripheral openings which alternate with six indentations, such as the indentations 33, 33*a*, 33*b*, 33*c*, 33*d* and 33*e*. The openings align with the first group of tall contacts while the indentations align with the second group of outer but short contacts.

Figure 5:
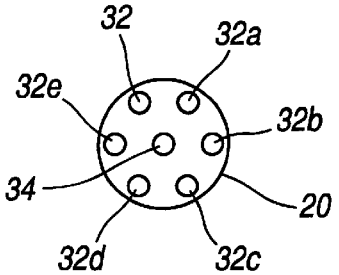
FIG. 5 is a top plan view of a ground common plate.

Referring to FIG. 5, the ground common plate 20 also has an array of peripheral openings, such as the holes 32, 32*a*, 32*b*, 32*c*, 32*d* and 32*e*, which are aligned with the third group of inner short contacts. Again, the openings of the plate are slightly smaller in diameter than the diameter of the contacts. In addition, a central opening, such as the hole 34, is provided.

Figure 6:
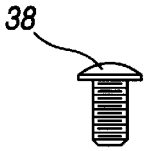
FIG. 6 is an elevational view of a screw.
Figure 7:
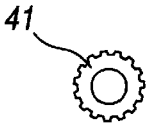
FIG. 7 is a top plan view of a lock washer.
Figure 8:
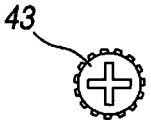
FIG. 8 is a top plan view of the screw and lock washer combination.
Figure 11:
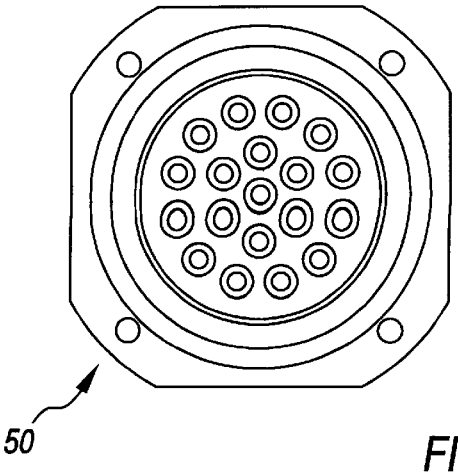
FIG. 11 is a bottom plan view of the electrical connector shown in FIGS. 9 and 10.

Each contact of the first group of tall contacts and the third group of short contacts have longitudinal bores or threaded openings, such as shown by the opening 36 of the contact 39 of the FIGS. 9–11 embodiment, to receive a fastener, such as screws exemplified by the screw 38 FIGS. 2, 3 and 6. The screw 38 is also illustrated in FIGS. 9 and 10. There are a plurality of screws which may be used to fasten the neutral common plate 18 to the first group-tall contacts and which may also be used to fasten the ground common plate 20 to the third group-short contacts. An additional fastener, such as the screw 40, may be provided through the central opening 28 of the neutral common plate and an additional fastener, such as the screw 42 may engage the ground common plate through its central opening 34. More typically, a lock washer, such as the washer 41, FIG. 7, is mated with each screw so that in plan view a screw-washer combination 43 appears as in FIG. 8.

It can now be appreciated that the large and small plates may easily be connected to the first and third groups of contacts, respectively, but without fear that the plates will vibrate loose from their contacts or loosen from removal and reinstallation activity.

Using this apparatus the individual contacts are through the respective plates electrically connected to other contacts and individual wires may also be easily connected at any or all of the screw-lock washers to electrically connect the connector with other circuitry or components. A wire may also be used and connected to the middle screw 40 for communication with circuitry or a component. The same is true of a wire connection using the screw 42.

In this fashion, the connector may be found to be quite reliable, easy to use and relatively inexpensive.

Another embodiment of the connector is shown in FIGS. 9 and 10. There, the connector 50 has a generally cylindrical body 51 and the three groups of electrical contacts. Some of the short contacts are configured in a small circular array and are exemplified by the contact 52. Other short contacts are in the larger outer circular array as described above regarding the FIGS. 1–3 embodiment. The tall contacts are connected to the plate 30. A second plate 54 electrically connects the contacts of the third group by a plurality of screws and lock washers, exemplified by the screw 56.

The first and second groups of contacts are configured in a large circular array and, as with the earlier embodiment, may alternate with one another. Thus, the first group may be labeled with even numbers while the second group may be labeled with odd numbers. Connecting the even numbered first group of contacts is the neutral common plate 30. A positive connection is made by using the screw-lock washer combinations as explained above. Having the second group of contacts at a shorter height than the first group of tall contacts insures that no direct electrical connection is made between the second group of contacts and the neutral common plate. It is also seen that by proper spacing, no electrical connection is made directly between the second group of contacts and the third group of contacts or the ground common plate 20. As described, the first and third groups of contacts have threaded holes to receive the screws. The second group may also be so constructed.

The specification describes in detail two embodiments of the present invention. Other modifications and variations will, under the doctrine of equivalents, come within the scope of the appended claims. For example, adding more contacts and more openings to the plates or making the second group of contacts the same height as the first group, or an intermediate height between the tall and short heights are considered to be equivalent structures. Adding more contact groups of the same or different heights are also considered to be equivalent. Still other alternatives will also be equivalent as will many new technologies. There is no desire or intention to limit in any way the application of the doctrine of equivalents.

I claim:

1. An electrical connector comprising:

a housing;

a plurality of electrically conductive contacts mounted to said housing;

said contacts being divided into at least three groups;

a first electrically conductive plate having a plurality of openings connected to a first group of said at least three groups of contacts;

a second electrically conductive plate having a plurality of openings to be used to connect to a third group of said at least three groups of contacts; and wherein a second group of said at least three groups of contacts does not make electrical contact with either said first or said second electrically conductive plates.

2. An apparatus as claimed in claim 1 wherein:

said first and second groups of contacts are arranged in a first circular configuration; and said third group of contacts is arranged in a second circular configuration.

3. An apparatus as claimed in claim 1 wherein:

said electrically conductive contacts each have a bore for engaging a fastener; and a plurality of fasteners for connecting said first and said second electrically conductive plates to preselected electrically conductive contacts by engaging said bores.

4. An apparatus as claimed in claim 1 wherein:

said first group of contacts is longer than said second and third groups of contacts;

said first and second groups of contacts are arranged in a first circular configuration;

said third group of contacts is arranged in a second circular configuration;

said first electrically conductive plate has a central opening;

said second electrically conductive plate has a central opening;

said electrically conductive contacts each have a bore for receiving a fastener;

a plurality of fasteners for connecting said first and said second electrically conductive plates to preselected electrically conductive contacts by engaging said bores;

electrically conductive fastener mounted to said first electrically conductive plate at said central opening of said first electrically conductive plate; and an electrically conductive fastener mounted to said second electrically conductive plate at said central opening of said second electrically conductive plate.

5. An apparatus as claimed in claim 1 wherein:

said first group of contacts is longer than said second and third groups of contacts.

6. An apparatus as claimed in claim 2 wherein:

said second group of contacts is longer than said third group of contacts.

7. An apparatus as claimed in claim 1 wherein:

said first electrically conductive plate has a central opening.

8. An apparatus as claimed in claim 5 including:

an electrically conductive fastener mounted to said first electrically conductive plate at said central opening of said first electrically conductive plate.

9. An apparatus as claimed in claim 1 wherein:

said second electrically conductive plate has a central opening.

10. An apparatus as claimed in claim 6 including:

an electrically conductive fastener mounted to said second electrically conductive plate at said central opening of said second electrically conductive plate.

11. An electrical connector having an insulative housing and a plurality of electrically conductive contacts mounted to said housing wherein said plurality of electrically conductive contacts are divided into three groups; and including:

a first electrical conductive plate having a plurality of openings connecting said first electrically conductive plate to a first group of said three groups of electrically conductive contacts;

a second electrically conductive plate having a plurality of openings connecting said second plate to a third group of said three groups of electrically conductive contacts; and a second group of said three groups of electrically conductive contacts spaced from said first and second groups of electrically conductive contacts and spaced from said first and said second plates.

12. An apparatus as claimed in claim 11 including:

a plurality of fasteners adapted to be placed through said openings of said electrically conductive plates to connect said plates to respective groups of electrically conductive contacts.

13. An apparatus as claimed in claim 12 wherein:

said openings of said second plate are arranged in a circular configuration; and including:

a centrally disposed opening.

14. An apparatus as claimed in claim 13 wherein:

said openings of said first plate are arranged in a circular configuration; and including:

a centrally disposed opening.

15. An apparatus as claimed in claim 14 wherein:

said first plate includes a plurality of indentations alternating with said openings in a circular configuration.

16. An apparatus as claimed in claim 15 including:

a plurality of fasteners adapted to be placed through said openings of said first and second electrically conductive plates to connect said plates to respective groups of electrically conductive contacts.

17. An apparatus as claimed in claim 16 including:

a centrally disposed opening in said first plate;

a fastener disposed in said central opening of said first plate; and a fastener disposed in said central opening of said second plate.

* * * * *